United States Patent [19]

White et al.

[11] Patent Number: 4,957,213

[45] Date of Patent: Sep. 18, 1990

[54] CARD FILE STOP

[76] Inventors: Dennis H. White, 308 Ries Rd., Ballwin, Mo. 63021; Danny W. Schoenwalder, 157 E. Forest Parkway, Valley Park, Mo. 63088

[21] Appl. No.: 488,691

[22] Filed: Mar. 5, 1990

[51] Int. Cl.[5] ..... B65D 1/24

[52] U.S. Cl. ..... 220/559; 220/551; 220/541; 206/425

[58] Field of Search ..... 220/22.1–22.6; 206/428

[56] References Cited

U.S. PATENT DOCUMENTS

| | | | |
|---|---|---|---|
| 486,434 | 11/1892 | Colton | 206/425 |
| 948,857 | 2/1910 | Haskeil | 206/425 |
| 1,541,173 | 6/1925 | Ormond | 220/22.6 |
| 1,641,600 | 9/1927 | Ormond . | |
| 2,281,465 | 4/1942 | Straubel | 206/425 |
| 2,306,446 | 12/1942 | Johnson | 206/425 |
| 2,338,898 | 1/1944 | Bradner | 206/425 |
| 2,882,575 | 4/1959 | Meyer | 206/425 |
| 3,892,481 | 7/1975 | Bruins | 220/22.3 |
| 4,102,470 | 7/1978 | Timmons | 220/22.3 |
| 4,722,453 | 2/1988 | Hamilton | 206/425 |

*Primary Examiner*—Joseph Man-Fu Moy

[57] ABSTRACT

A file stop for index card trays, file drawers and the like is provided. The file stop is comprised of a plate-like member bent at a substantially right angle and a tubular telescoping element attached to the back of the upright portion of the plate-like member. The telescoping element is adjustable so that the ends can be placed in biased relation with the side walls of the card tray, file drawer or the like. The file stop is further held in place by means of abrasive surfacing on the ends of the tubular telescoping element.

9 Claims, 1 Drawing Sheet

FIG. 1
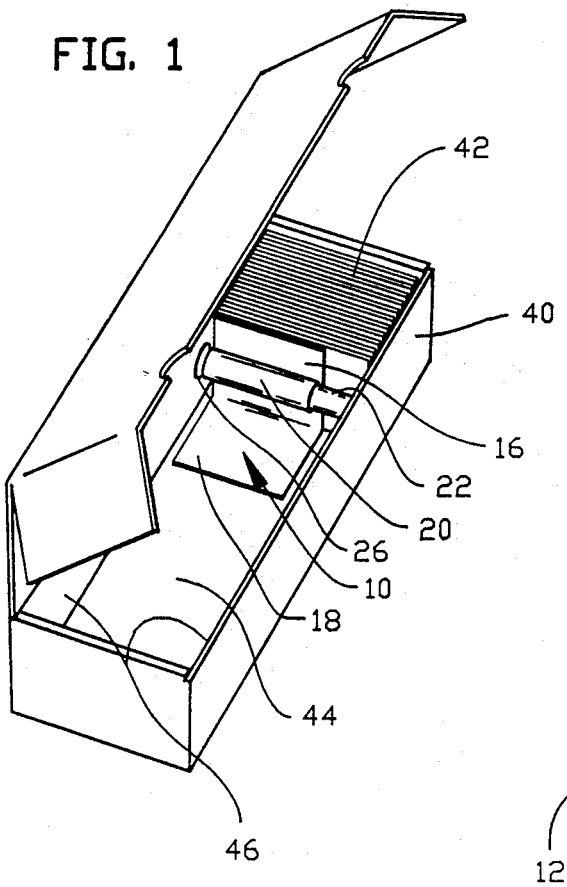
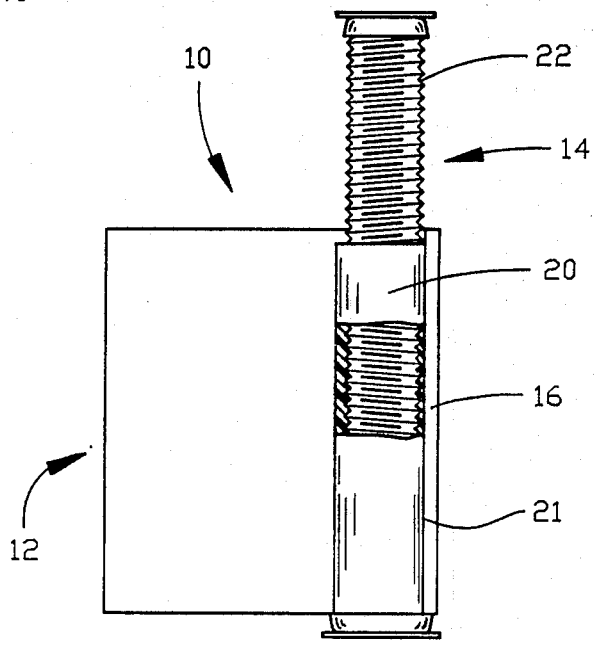
FIG. 2
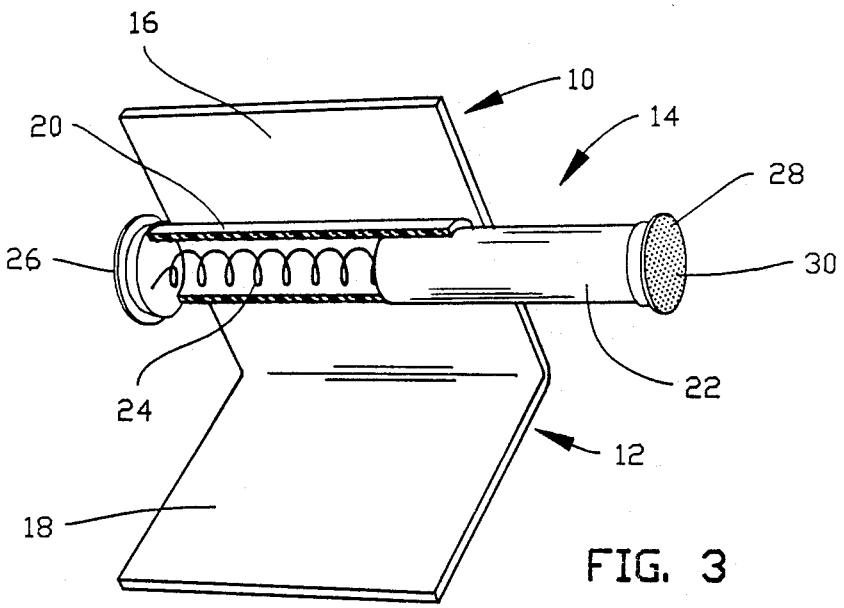
FIG. 3

CARD FILE STOP

BACKGROUND OF THE INVENTION

This invention was conceived in response to a problem that exists in the hobby of card collecting, although the problem is felt in any situation where filed items are kept. The problem is in maintaining an orderly collection and storage of cards. A card collector will find that he has amassed a large quantity of cards; in order to efficiently retrieve his cards from time to time he must have an orderly system for storing those cards. Specially sized boxes have been developed, for instance in the area of baseball card collecting, that conform to the particular dimensions of the card. This enables the collector to store his cards in a manner as he would for any other filing system.

The problem still exists however, if the cards are not secured down in the box. If the box is upended, the cards will be strewn about and the collector's orderly filing system will be disrupted; thus, his painstaking task of organizing the cards must by repeated. In view of the heightened interest in card collecting, it is important that a collector have ready access to any particular card at any given time. Therefore, features like that in a conventional file drawer, such as back stops, are needed in card boxes. However, many card boxes are constructed of simple material and can not incorporate the usual hardware of file drawers that comprise back stops.

There exist, in the prior art, file stops which are added to drawers and the like which help to hold up files, but they usually require pre-existing grooves in the sides of the drawers, or hang over the edge of the drawers. These are inefficient and cumbersome and are inappropriate for use with card boxes.

Therefore, there exists a need for a file stop for holding cards securely in card boxes that is inexpensive and simple in construction. It is desirable that such a file stop be an independent article so that it could be readily inserted and removed from the file box as required.

SUMMARY OF THE INVENTION

By means of the instant invention there is provided a card file stop which is used to hold baseball cards and the like securely in boxes adapted for that purpose. The ultimate application of this invention, however, can be carried over to conventional file drawers and trays of many types.

The invention is comprised of a plate-like member which is bent at a 90 degree angle, and a tubular telescoping element which is secured to the back of the upright portion of the member. The plate-like member functions in the manner of a conventional book-end with the base portion of the plate member lying on the bottom of the file box or drawer and the upright portion of the member bracing against the cards or files, keeping them in an upright position. The tubular telescoping element has ends which engage the walls or sides of the drawer or file in biased relation and hold the file stop in place. The ends may be equipped with abrasive surfaces to insure against backward slippage by the file stop.

The tubular telescoping element may be threaded or spring biased so that the ends may be forcibly engaged against the walls or sides of the file drawer. Abrasive pads may be placed on the underneath side of the base portion of the plate member to further insure against backward slippage of the stop.

The file stop of the invention is simple in construction and inexpensive to manufacture. It can be adapted to fit in file boxes of various width by means of the telescoping element. It may also be made in a larger scale for use in conventional filing drawers. It requires no pre-existing channels or grooves in the file drawers.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

FIG. 1 is a perspective view of the invention as it is employed in a card file box;

FIG. 2 is a top plan view partly broken away showing an embodiment of the invention featuring threaded means; and FIG. 3 is a perspective view of the invention showing the tubular element partially broken away to reveal spring biasing means as another embodiment of the invention.

DESCRIPTION OF THE INVENTION

The card file stop of the invention is generally identified by the reference numeral 10 in FIGS. 1–3. The stop is comprised of a plate-like member 12 to which is attached a tubular telescoping element 14 as shown in FIGS. 2 and 3.

Plate-like member 12 is bent at a substantially right angle, resulting in upright portion 16 and base portion 18 as best shown in FIG. 3. Tubular telescoping element 14 is comprised of receiving sheath 20 which accepts shaft 22. Shaft 22 is externally threaded and sheath 20 is internally threaded and receives shaft 22 as shown in FIG. 2. In another embodiment, the sheath and shaft are unthreaded and spring means 24 are placed within sheath 20 to urge shaft 22 outwards from within sheath 20 as seen in FIG. 3. Tubular element 14 is secured to the back of upright portion 16 in any conventional manner such as by gluing, or may be integrally constructed with the upright portion. FIG. 2 shows outside edge 21 of sheath 20 secured to upright portion 16.

Sheath 20 and shaft 22 have end plates 26 and 28, respectively. These end plates may be surfaced with an abrasive non-slipping material 30 as shown in FIG. 3.

USE

The card file stop of the instant invention is very simply employed as a device for holding cards upright in boxes as shown in FIG. 1. Although the embodiment depicted is used in special boxes for baseball cards and the like, it is understood that the file stop may be used in any file or drawer to hold filed items upright. The file box of FIG. 1 is indicated by reference numeral 40. Cards or other filed material are indicated by numeral 42.

The file stop 10 is placed in the file box so that the base portion 18 lies on the file box floor 44. Upright portion 16 is placed against cards 42, sufficiently close enough to maintain said cards in an upright position. Although the preferred embodiment teaches the bent angle between the upright portion 16 and base portion 18 to be a substantially right angle, it is understood that the angle may be somewhat less than 90 degrees, whereby the cards may rest in a backward tilted position.

The file stop 10 is held securely in place by tubular telescoping element 14 whose ends 26 and 28 are biased against the walls of the file box 46. In the threaded embodiment, the shaft 22 is manually unthreaded from sheath 20 until the length of tubular element 14 is the same as or slightly greater than the width of the file box. This is done before the stop is inserted in the box. In the embodiment featuring the tubular element with the spring biasing means, no adjustment is necessary; the ends 26 and 28 will automatically expand to engage the side walls 46. Ends 26 and 28 may have a non-slip abrasive material thereon to further ensure against slipping of the file stop. In addition, non-slip material may be placed on the bottom of base portion 18.

It is understood that the file stop may be constructed entirely of plastic, wood, metal or other like materials. While the use of this invention has been developed for use in file boxes for baseball cards and the like, it is to be understood that the invention may be employed in large filing cabinets, drawers and the like by increasing the size scale of the file stop of the invention.

Various changes and modifications may be made within this invention as will be apparent to those skilled in the art. Such changes and modifications are within the scope and teaching of this invention as defined in the claims appended hereto.

What is claimed is:

1. A file stop support for use in a file drawer or the like comprising a plate-like member and a tubular telescoping element, said member having a base portion and an upright portion, said tubular telescoping element being attached to a back side of said upright portion in an orientation transverse to side walls of said drawer, said tubular telescoping element having two ends, at least one of said ends axially extending out to engage in biased relation said side walls of said drawer.

2. The file stop support of claim 1 in which both of said ends of said tubular telescoping element engage said side walls of said drawer in biased relation.

3. The file stop support of claim 1 in which said tubular telescoping element is threaded for axial adjustment.

4. The file stop support of claim 1 which said tubular telescoping element is provided with spring biasing means whereby said ends are urged apart to provide said biased relation against said side walls of said drawer.

5. The file stop support of claim 1 which said ends have an abrasive surface whereby said file stop support resists movement away from said biased relation with said walls.

6. The file stop support of claim 1 in which said base portion has an abrasive surface whereby said file stop support resists movement from its position.

7. The file stop support of claim 1 in which said member is shaped as a substantially right angle.

8. The file stop support of claim 1 in which said tubular telescoping element is threaded for axial adjustment, said ends have an abrasive surface, and said base portion has an abrasive surface whereby said file stop support resists movement from its position.

9. The file stop support of claim 1 in which said tubular telescoping element is integrally constructed with said back side of said upright portion.

* * * * *